US006298682B1

(12) United States Patent
Ramos et al.

(10) Patent No.: US 6,298,682 B1
(45) Date of Patent: Oct. 9, 2001

(54) CONDENSATE DEFLECTOR FOR AN AIR CONDITIONER

(75) Inventors: Paulo Augusto Lisboa Ramos, Esteio; Gilberto Fagundes de Souza, Porto Alegre, both of (BR)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/554,052

(22) PCT Filed: Sep. 16, 1998

(86) PCT No.: PCT/BR98/00077

§ 371 Date: May 9, 2000

§ 102(e) Date: May 9, 2000

(87) PCT Pub. No.: WO00/16021

PCT Pub. Date: Mar. 23, 2000

(51) Int. Cl.[7] ..... F25B 47/00; F25B 39/04
(52) U.S. Cl. ..... 62/280; 62/183
(58) Field of Search ..... 62/280, 183, 279, 62/305

(56) References Cited

U.S. PATENT DOCUMENTS

| | | | | |
|---|---|---|---|---|
| 3,079,769 | | 3/1963 | Philco-Ford . | |
| 3,766,751 | * | 10/1973 | Ball | 62/280 |
| 3,783,637 | * | 1/1974 | Woods . | |
| 3,811,293 | | 5/1974 | Flynn | 62/280 |
| 4,248,057 | | 2/1981 | Yaguchi | 62/280 |
| 4,793,148 | * | 12/1988 | Ikari et al. | 62/280 |
| 5,272,886 | * | 12/1993 | Ukai et al. | 62/280 |

FOREIGN PATENT DOCUMENTS 2205938 12/1988 (GB) .

* cited by examiner

*Primary Examiner*—Henry Bennett
*Assistant Examiner*—Chen-Wen Jiang

(57) ABSTRACT

An orifice member for the condenser fan of an air conditioning unit. The air conditioning unit has a basepan, which supports a condenser coil and a condenser fan disposed forwardly of the condenser coil. The fan has a slinger ring formed at the outer periphery thereof. The slinger ring and the basepan are configured such that condensate water from the air conditioning unit will collect in the basepan underlying the bottom of the fan so that the slinger ring will be immersed in the collected water, pick up the water and direct it towards the condenser coil. The orifice member is provided with a fan orifice therein located forwardly of the fan so that the fan draws air through the orifice opening and directs it through the condenser coil. A diverter and a deflector cooperate to prevent water picked up by the slinger from being directed radially outwardly and through openings in the housing. The diverter is located on the orifice at a position offset from the bottom of the orifice in the direction of rotation of the fan. The diverter element also extends radially into the orifice. The deflector is an arcuate surface located on the orifice member at a position adjacent the orifice and extends in one direction from a position angularly displaced from the diverter element, in the direction of rotation of the fan, to a position extending at least to a lateral edge of the orifice. The deflector surface also extends for a distance forwardly from said orifice.

3 Claims, 5 Drawing Sheets

CONDENSATE DEFLECTOR FOR AN AIR CONDITIONER

TECHNICAL FIELD

This invention relates to room air conditioners and is more specifically directed to the configuration of the condenser coil fan orifice to prevent the discharge of collected condensate and water from the side of the air conditioner housing.

BACKGROUND ART

Room air conditioners quite often have a slinger ring associated with the condenser fan on the outdoor side of the unit. The slinger is adapted to pass through a pool of condensate water collected in the unit's basepan underlying the condenser fan and to thereby direct a water spray along with a flow of cooling air across the unit's condenser heat exchanger. The outer housing of the air conditioner unit contains a plurality of openings therein through which the air directed by the condenser fan over the condenser heat exchanger is drawn into the housing. Under some circumstances, some of the water picked up by the condenser fan slinger ring will be splashed radially outwardly and through the side openings in the housing. This condition is considered undesirable in that the water could splash on adjacent structures and will drip onto anything located under the unit and thus cannot be controlled by way of the usual means for collecting and disposing of excess condensate.

DISCLOSURE OF THE INVENTION

According to the present invention, an orifice member is provided for the condenser fan of an air conditioning unit. The air conditioning unit has a basepan, which supports a condenser coil at the rear thereof and a condenser fan disposed forwardly of the condenser coil. The fan has a slinger ring formed at the outer periphery thereof. The slinger ring and the basepan are configured such that condensate water from the air conditioning unit will collect in the basepan underlying the bottom of the fan so that the slinger ring will be immersed in the collected water, pick up the water and direct it towards the condenser coil. The air conditioning unit further includes an outer housing having openings therein adjacent the condenser fan. An orifice member is provided with a fan orifice opening therein located generally forwardly of the fan so that in operation the fan draws air through the openings in the housing, through the orifice opening and directs it rearwardly through the condenser coil. Means are provided for preventing water picked up by the slinger ring from being directed radially outwardly and through the openings in the housing. The means includes a diverter element located on the orifice at a position offset from the bottom of the orifice in the direction of rotation of the fan. The deflector element extends radially inwardly into the orifice opening. An arcuate deflector surface is located on the orifice member at a position adjacent the orifice opening and extending in one direction from a position angularly displaced from the diverter element in the direction of rotation of the fan to a position extending at least to a lateral edge of the orifice. The deflector surface also extends for a distance forwardly from the orifice.

BRIEF DESCRIPTION OF THE DRAWINGS

The invention may be better understood and its objects and advantages will become apparent to those skilled in the art by reference to the accompanying drawings, in which.

BEST MODE FOR CARRYING OUT OF THE INVENTION AND INDUSTRIAL APPLICABILITY

Figure 1:
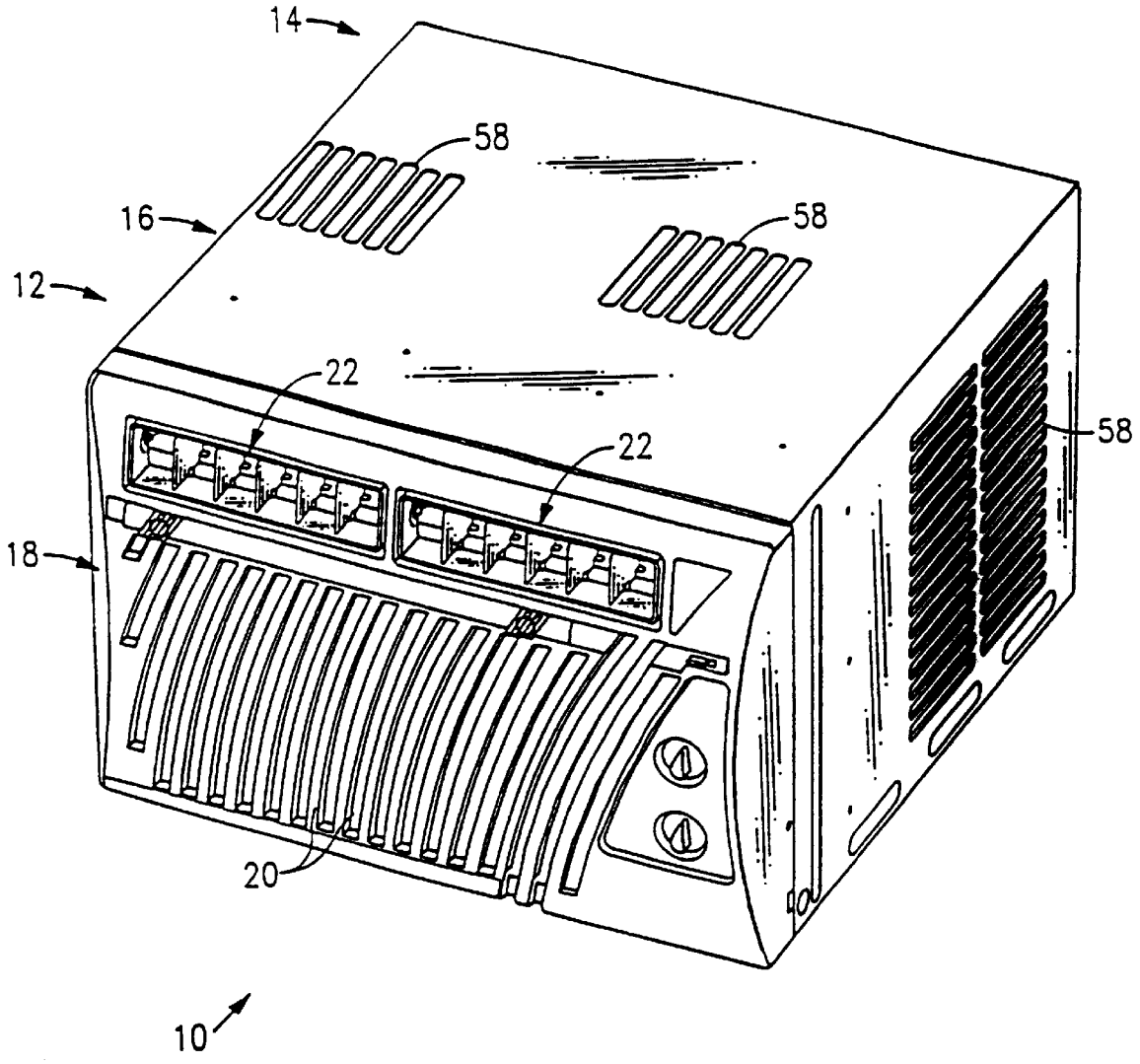
FIG. 1 is a perspective view of a room air conditioner which embodies the features of this invention.

FIG. 1 illustrates a room air conditioner unit 10. which includes. generally, an indoor section 12 and an outdoor section 14. The room air conditioner is enclosed in a substantially rectangular housing 16 and is adapted to be positioned in a rectangular opening in an exterior wall or in a window in a room where cooling is desired, with the indoor section 12 facing into the room, as is conventional. The indoor section 12 includes an indoor grille 18, which includes inlet louvers 20 and a pair of air discharge assemblies 22.

Figure 2:
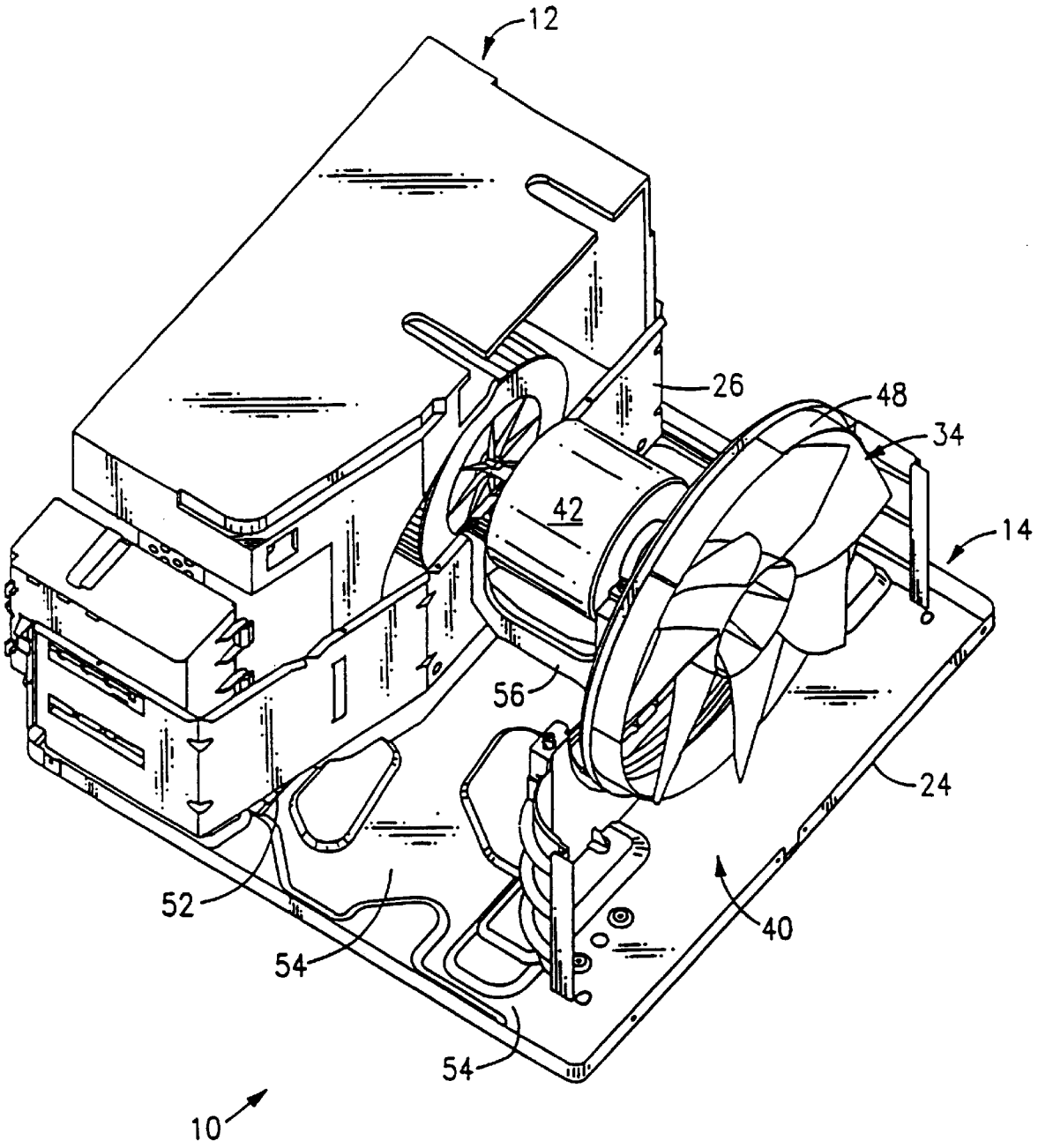
FIG. 2 is a rear perspective view of the air conditioner of FIG. 1 with the outer cover and a number of the internal components removed therefrom to illustrate the present invention.
Figure 3:
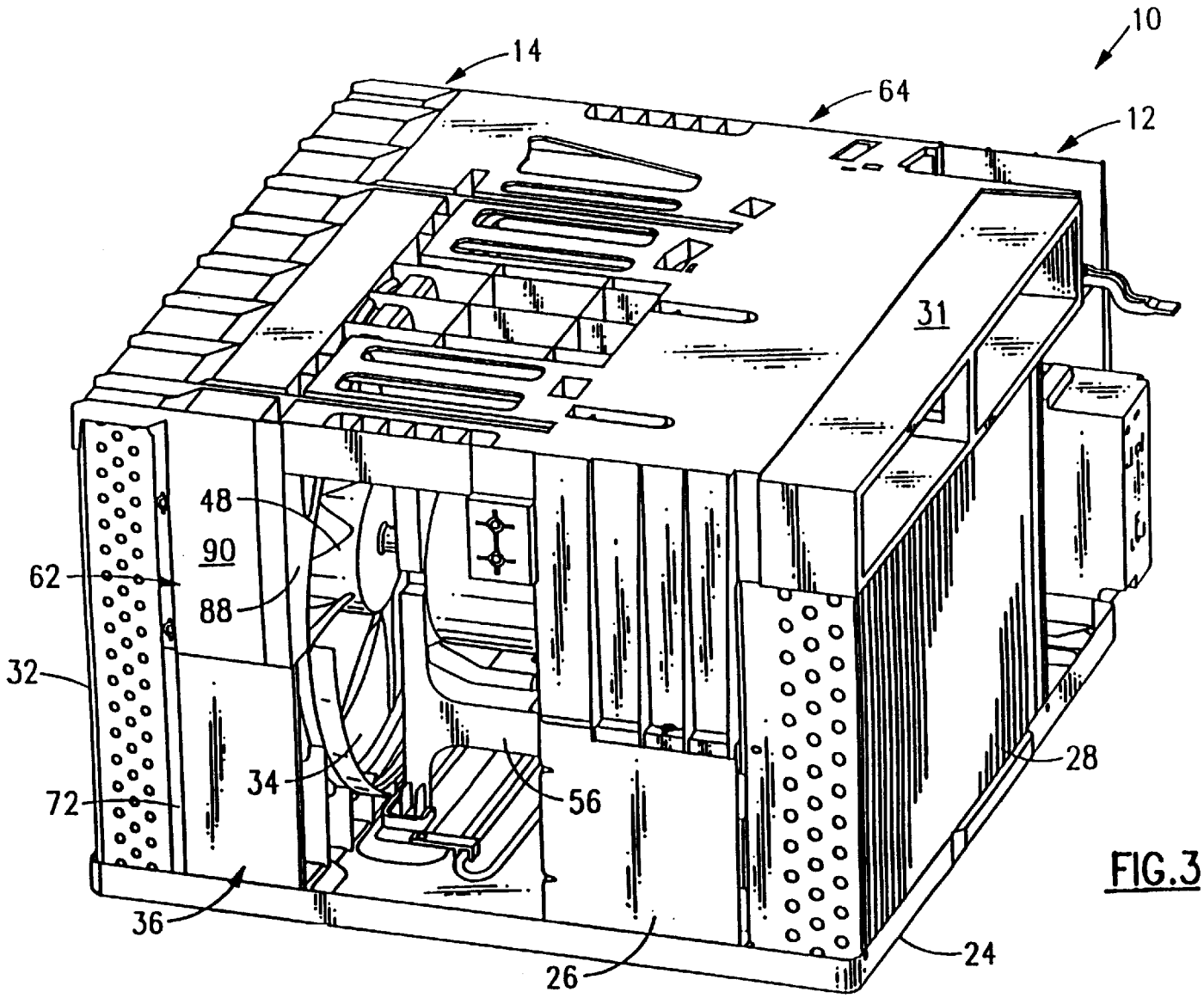
FIG. 3 is a front perspective view of the air conditioning unit of FIG. 1 with the outer cover and front grille removed therefrom.
Figure 6:
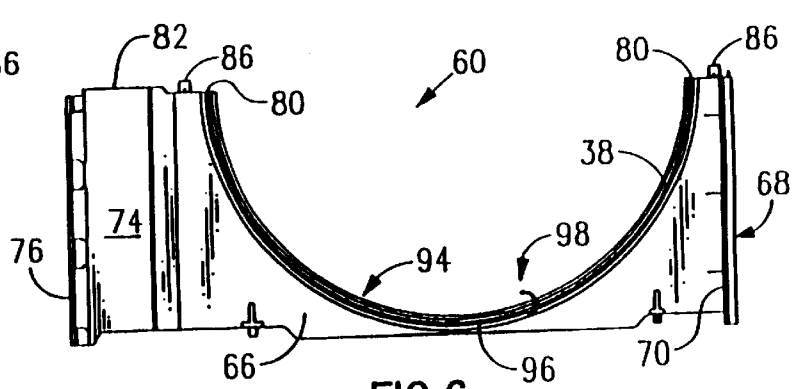
FIG. 6 is a rear plan view of the condenser fan orifice member illustrated in FIG. 4.
Figure 5:
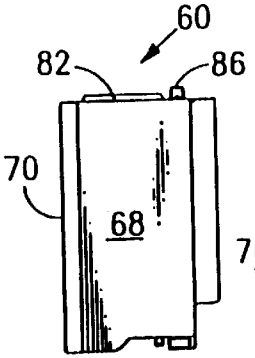
FIG. 5 is a left side view of the condenser fan orifice member illustrated in FIG. 4.
Figure 4:
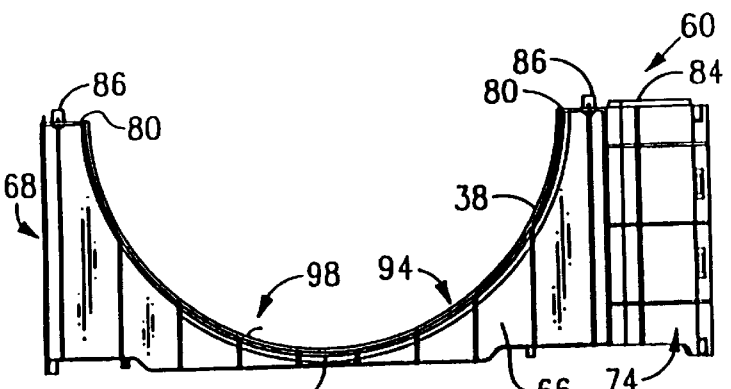
FIG. 4 is a front plan view of the lower section of the condenser fan orifice member incorporating the present invention.
Figure 9:
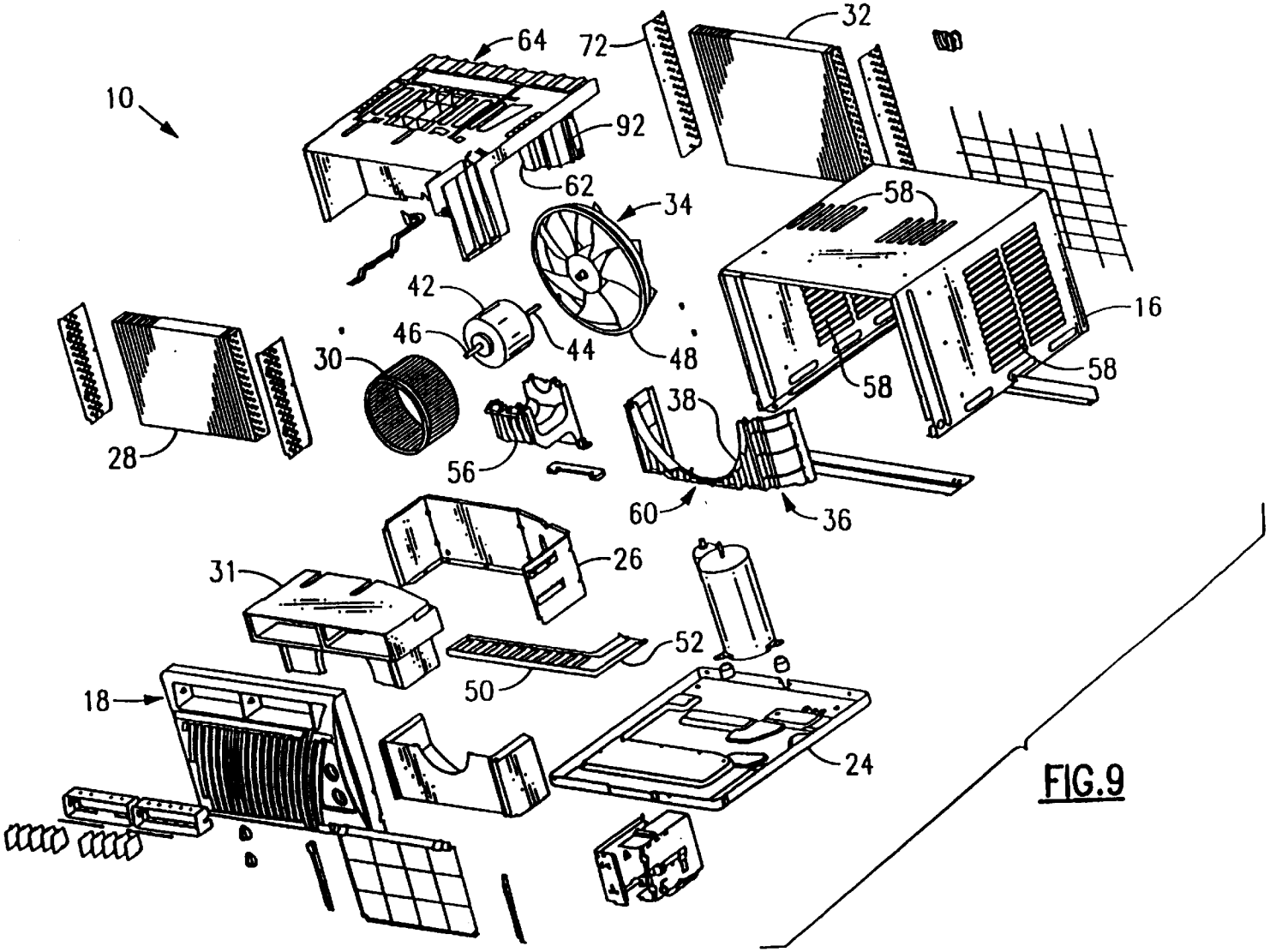
FIG. 9 is an exploded view of the window room air conditioner unit illustrated in FIG. 1.

Looking now at FIGS. 2, 3 and 9, the components of both the indoor section 12 and the outdoor section 14 are supported in a rectangular basepan 24. The indoor and outdoor sections are separated in part by a vertically extending metal partition 26. The indoor section comprises basically an evaporator coil 28 vertically disposed at the front end thereof, an evaporator or indoor fan 30 located behind the evaporator coil 28 and an air directing scroll 31.

The outdoor section 14 includes a condenser coil 32 vertically disposed adjacent the back end thereof with its discharge side facing the outside and a condenser fan 34 located within the outdoor section adjacent the condenser coil. A condenser fan shroud 36 is connected to the condenser coil 32, the basepan 24 and the interior of the housing 16 such that a fan chamber 40 containing the moving portion of the condenser fan 34 is formed. The condenser fan shroud 36 includes an inlet orifice 38. The condenser fan 34 is of the axial, shrouded propeller type and is located in the fan chamber 40 adjacent to the inlet orifice 38. The condenser fan 34 is connected to an electric motor 42 via drive shaft 44. A drive shaft 46 extending from the other side of the electric motor is connected to the evaporator fan 30 such that both of fans 30 and 34 are commonly driven. A rotating shroud or suction slinger 48 is secured to the outer periphery of the condenser fan 34.

In operation, motor 42 commonly drives evaporator fan 30 and condenser fan 34. Evaporator fan 30 draws air from the room to be cooled with the air serially passing through inlet louvers 20, evaporator coil 28 where the air is cooled, fan 30 and vents through air discharge assemblies 22 back into the room. In cooling the air during its passage through the evaporator coil 28. condensate commonly forms as the air is dehumidified. This condensate is collected within a condensate collection pan 50 supported by the basepan 24 within the indoor section 12. The condensate flows through an extension 52 of the condensate pan under the partition 26, as best seen in FIG. 2. The basepan 24 in the outdoor section 14 is provided with a plurality of low elevation passageways. collectively 52, which allow condensate to flow to and collect in the region 54 underlying a fan support structure 56 and, further, allows condensate to pass behind the condenser fan shroud 36 and the condenser coil 32 into the region 55 of the basepan underlying the fan chamber 40.

At the same time. the condenser fan 34 draws outside air into the housing 16 through inlet louvers 58 formed in the top and sides thereof and the air passes serially through the condenser inlet orifice 38, and the condenser coil 32 where heat is rejected to the outside air.

During such operation, following accumulation of condensate in the region 55 underlying the condenser fan 34. the fans slinger ring 48 becomes immersed in collected condensate. The slinger ring 48 picks up a portion of such condensate and directs it into the air flow directed onto the condenser coil 32 to thereby cool the coil and, accordingly, improve the efficiency of operation of the air conditioning unit.

The condenser fan shroud 36 is formed from a one-piece lower section 60 and an upper section 62. which is an integral part of a large upper molded plastic section 64. The plastic section 64 serves other support functions in the construction of the air conditioning unit, which are not relevant to the present invention. For purposes of describing direction, the following conventions will be used in connection with the description which follows. The terms "left" and "right" will be with respect to the air conditioning unit as viewed in FIGS. 1 and 9. Further, the terms "rearward" and "forward" will be with respect to the air conditioning unit and its components as viewed in FIGS. 1 and 9. with the forward section of the unit being the indoor section 12 having the indoor grille 18 mounted thereon.

Further, for purposes of disclosed embodiment, the direction of rotation of the condenser fan as viewed from the front of the unit is in a clockwise direction. The lower section 60 of the condenser fan shroud 36 is illustrated in detail in FIGS. 4–8. The lower shroud section 60 includes a main wall section 66 in which one-half of the inlet orifice 38 is formed. Extending rearwardly from the left-hand side of the main wall section 66 is a side wall 68. which has formed on its rear edge 70 thereof structure for engaging the left-hand tube sheet 72 of the condenser coil 32. Extending from the right-hand side of the main wall section 66 is a curved wall 74, which extends to the right and rear and terminates in a rear edge 76 which includes structure thereon for engaging the right-hand tube sheet 78 of the condenser coil 32. The main wall 66, the left side wall 68 and the right side wall 74 each define an upper edge 80, 82 and 84, respectively The upper edge 80 of the main wall section is split into two small portions, each of which carries an upstanding positioning pin 86.

Figure 8:
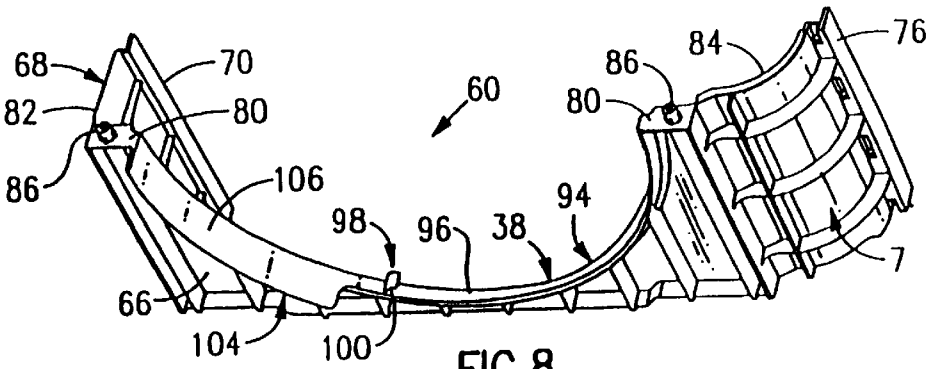
FIG. 8 is a right perspective view of the condenser fan orifice member of FIG. 4.
Figure 7:
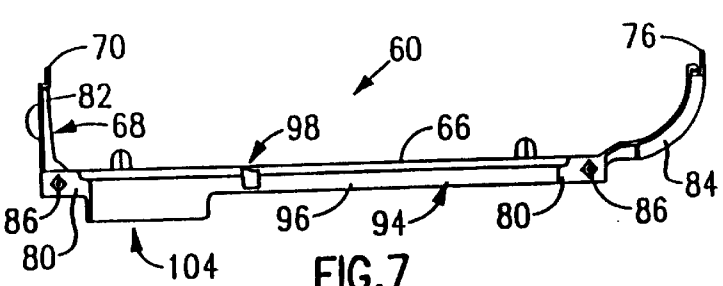
FIG. 7 is a top view of the condenser fan orifice member illustrated in FIG. 4.

The upper section of the condenser fan shroud includes a main wall section 88, a left-hand side wall 90 and right-hand side wall 92, which are configured substantially identically to the main wall 66, the left side wall 68 and the right side wall 74 of the lower section 60, respectively. Each of the walls 88, 90 and 92 of the upper section define a downwardly facing edge, which is configured to sealingly engage the mating edges 80 82 and 84 of the lower section 60. Further, the mating edges of the upper main wall 88 are provided with recesses therein (not shown) which are adapted to receive the upstanding pins 86 carried by the upper edge of the main wall 66 of the lower section. Accordingly, the upper and lower sections 60 and 62 cooperate to define the condenser fan shroud 36 and the circular inlet orifice 38. The inlet orifice 38 is defined by a narrow. substantially flat peripherally extending circular surface 94. Integrally formed with the circular surface 94 and displaced from the lower most portion 96 of the circular surface. in a counterclockwise direction, is a diverter element 98 which, as best seen in FIG. 8, comprises a curved wall 100 which presents a water engaging surface 102 to the right. Also integrally formed with the circular surface 94, and located thereon in a counterclockwise direction beginning at a point displaced from said diverter element 98 by a small distance and extending to a position adjacent the left-hand upper edge 80 is a curved deflector element 104. The deflector element 104 presents an arcuate curved surface 106 which extends forwardly from the main wall section 66 by a dimension at least twice that of the width of the circular surface 94 defining the inlet orifice 38.

During operation of the air conditioning unit, with a condensate pool formed under the condenser fan slinger 48, water picked up by the condenser fan slinger which would otherwise be thrown laterally and radially on the forward side of the condenser fan shroud and outwardly through the inlet louvers 58 will be caused to impinge upon the curved surface 102 of the diverter element 98, which will cause the water to be diverted in a direction substantially to the right and upwardly. Such water will then be caused by rotation of the fan to travel to the left and thence will contact the curved surface 106 of the deflector element 104 and then, under influence of gravity, flow downwardly and to the right and into the region of the basepan 24 underlying the fan support structure 56.

As a result, the air conditioning unit may have an effective condenser fan slinger, as well as large open low restriction air flow louvers 58 on the lateral sides thereof without the disadvantage of having excess water from the slinger thrown outwardly from the housing 16 through the open louvers.

What is claimed is:

1. An orifice member for a condenser fan of an air conditioning unit, the air conditioning unit having a basepan which supports a condenser coil at the rear thereof with the condenser fan disposed forwardly of the condenser coil, the fan having a slinger ring formed at the periphery thereof, the slinger and the basepan being configured such that condensate water from the air conditioning unit will collect in the basepan adjacent the bottom of the fan so that the slinger ring will be immersed in the collected water and pick it up and direct it toward the condenser coil, the air conditioning unit further including an outer housing having openings therein proximate the condenser fan, the orifice member having a fan orifice opening therein located generally forwardly of the fan so that the fan draws air through the opening in the housing, through the orifice opening and directs it rearwardly through the condenser coil, wherein the improvement comprises:

means for preventing water picked up by said slinger ring from being directed radially outwardly and through said openings in said housing;

said means for preventing comprising:

a diverter element located on said orifice member at a position offset from the bottom of said orifice, in the direction of rotation of said fan, said diverter element extending radially inwardly into said orifice opening, said element being configured to direct condensate impinging thereon in substantially an upward direction; and an arcuate deflector surface located on said orifice member at a position adjacent said orifice opening and extending from a position angularly displaced from said diverter element in the direction of rotation of said fan to a position extending at least to a lateral edge of said orifice, said deflector surface also extending forwardly from said orifice.

2. The apparatus of claim 1 wherein said orifice member further includes a flat, peripherally extending circular surface defining said orifice opening, and wherein said diverter element comprises a curved wall having a fixed end integrally formed with said surface and presenting a curved water engaging surface, which faces opposite from the direction of rotation of said fan.

3. The apparatus of claim 2 wherein said arcuate deflector surface comprises a forward extension of said circular surface defining said orifice opening.

* * * * *